US009267222B2

(12) United States Patent
Schnaufer et al.

(10) Patent No.: US 9,267,222 B2
(45) Date of Patent: Feb. 23, 2016

(54) METHOD AND APPARATUS FOR VISUALIZING THE POSITION OF AN OPERATING HEAD RELATIVE TO A WORKPIECE

(75) Inventors: William E. Schnaufer, Rochester, NY (US); Neal A. Schwarzberger, The Woodlands, TX (US)

(73) Assignees: ABM International, Inc., The Woodlands, TX (US); Industrial Indexing Systems, Inc., Victor, NY (US)

( * ) Notice: Subject to any disclaimer, the term of this patent is extended or adjusted under 35 U.S.C. 154(b) by 856 days.

(21) Appl. No.: 13/358,232

(22) Filed: Jan. 25, 2012

(65) Prior Publication Data

US 2013/0190916 A1 Jul. 25, 2013

(51) Int. Cl.
*G06F 7/66* (2006.01)
*D05B 19/12* (2006.01)

(52) U.S. Cl.
CPC ..... *D05B 19/12* (2013.01)

(58) Field of Classification Search
CPC ..... D05B 19/02; D05B 19/04; D05B 19/06; D05B 19/08; D05B 19/085; D05B 19/10; D05B 19/105; D05B 19/12; D05B 19/14; D05B 19/16; D05B 11/00; D05B 21/00; D05D 2205/06; D05D 2205/08; D05D 2205/085
See application file for complete search history.

(56) References Cited

U.S. PATENT DOCUMENTS 4,860,675 A * 8/1989 Brower et al. ..... 112/119
4,876,976 A * 10/1989 Brower et al. ..... 112/475.05
4,969,410 A * 11/1990 Brower et al. ..... 112/475.19
4,998,489 A * 3/1991 Hisatake et al. ..... 112/103
5,027,726 A * 7/1991 Brower et al. ..... 112/117
5,095,835 A * 3/1992 Jernigan et al. ..... 112/475.05
5,323,722 A * 6/1994 Goto et al. ..... 112/102.5
5,553,559 A * 9/1996 Inoue et al. ..... 112/102.5
5,826,525 A * 10/1998 Hayakawa ..... 112/102.5
6,263,815 B1 * 7/2001 Furudate ..... 112/470.13
2004/0182295 A1 * 9/2004 Pfeifer ..... 112/119
2005/0016428 A1 * 1/2005 Koerner ..... 112/117
2006/0112866 A1 * 6/2006 Pfeifer et al. ..... 112/117

(Continued)

OTHER PUBLICATIONS

HQ Pro-Stitcher® User Manual: © 2010 Handi Quilter, Inc. (Aug. 19, 2010) 92 pages.

(Continued)

*Primary Examiner* — Nathan Durham

(74) *Attorney, Agent, or Firm* — Timothy W. Menasco, Esq.; Harter Secrest & Emery LLP

(57) ABSTRACT

A method and apparatus for stitching a workpiece, such as a quilt, is disclosed. The method comprises displaying a predetermined pattern on a display and manipulating the predetermined pattern on the display. The display includes an indicator corresponding to a position of a sewing head relative to the workpiece. The method further includes moving a control handle operably connected to the sewing head to move the indicator relative to the pattern on the display and move the sewing head relative to the workpiece. Devices to practice the method include sewing machines having a sewing head moveable relative to a workpiece and a control handle operably connected to the sewing head to move the sewing head relative to the workpiece, wherein the display showing a pattern to be sewn is mounted relative to the control handle for movement with the control handle.

31 Claims, 6 Drawing Sheets

(56) References Cited

U.S. PATENT DOCUMENTS

| | | | | |
|---|---|---|---|---|
| 2007/0204781 | A1* | 9/2007 | Noguchi | 112/470.06 |
| 2008/0006192 | A1* | 1/2008 | Zeiger et al. | 112/102.5 |
| 2009/0151612 | A1* | 6/2009 | Bentley | 112/470.04 |
| 2009/0195649 | A1* | 8/2009 | Gylling et al. | 348/125 |
| 2009/0272304 | A1* | 11/2009 | Watts | 112/118 |
| 2010/0186646 | A1* | 7/2010 | Stokes et al. | 112/470.05 |

OTHER PUBLICATIONS

HQ Pro-Stitcher™ User Manual (v. 1.0): The future of Quilting Possibilities is here! Copyright © 2007 (52 pages).

HQ Pro-Stitcher™ User Manual (v. 1.2.0): The future of Quilting Possibilities is here! Copyright © 2007-2008 (72 pages).

* cited by examiner

METHOD AND APPARATUS FOR VISUALIZING THE POSITION OF AN OPERATING HEAD RELATIVE TO A WORKPIECE

CROSS-REFERENCE TO RELATED APPLICATIONS

None.

STATEMENT REGARDING FEDERALLY SPONSORED RESEARCH OR DEVELOPMENT

None.

REFERENCE TO A "SEQUENCE LISTING"

None.

BACKGROUND OF THE INVENTION

1. Technical Field

The present invention relates to a system for visualizing a position of an operating head relative to a workpiece. In one configuration, the present system assists a user in making a pattern on a workpiece using a free-motion machine. A further configuration relates to sewing machines for quilting and more specifically to a method and apparatus for sewing quilting patterns onto a workpiece by displaying a pattern and an indicator on a display apparatus, the indicator corresponding to a position of a sewing head relative to the workpiece, and moving the display apparatus to move the indicator relative to the displayed pattern and move the sewing head relative to the workpiece.

2. Description of Related Art

A quilt is a coverlet that typically has three layers: a decorative top layer, a middle layer of insulating material, and a backing layer. Traditionally, the top layer is made by piecing together small pieces of material to form patterns or designs. Optionally, a border is formed around the top layer by sewing strips of material around the perimeter of the sewn pieces as a border. The quilt is assembled by stitching together the three layers in a quilting pattern using a rocking stitch, running stitch or straight stitch around the entire area of the quilt to secure the layers and to add decorative effect.

Quilts have been made throughout American history to use as bed coverings. Today, some even use quilts as decorative wall hangings or to make quilt-like clothing products or textiles. Over the years, quilting has become a popular hobby, in part because of technological advances in quilting sewing machines that have made the machines more affordable and quilting easier and faster. Many quilters have home quilting machines that allow one to select intricate quilting patterns to be stitched onto many yards of material. In addition, these quilting sewing machines are used by the textile industry to create all types of affordable quilted products.

A problem with these machines, however, is that they are large and difficult to handle. Further, because the user is located farther away from the needle when using a paper pantograph, or scroll, as a guide, it is difficult to follow a quilting pattern on a pantograph and observe the sewing quality.

In addition, the need to acquire and retain numerous scrolls is expensive and requires significant storage space.

Despite the machine providing a more efficient quilting experience, many users are still not satisfied with the quality of the stitching of the quilt.

To improve the accuracy and speed of quilting, computer-controlled quilting machines can be used. However, these machines are not desired by many because the user does not have control over the stitching. While the user may have higher quality stitching on the quilt, the users do not experience the satisfaction of creating the quilting design and sewing the quilting pattern themselves. The difficulties identified above are also encountered by those using other types of machines to make patterns on a workpiece, for example, patterns in wood with routers and drill presses and patterns in material with home sewing machines.

Therefore, the need exists for a machine that allows a user to be more involved in the pattern making process. The need also exists for allowing manipulation of patterns that have traditionally been fixed on a scroll or generated by freehand. The need also exists for a machine that improves the look of the overall design. Further, the need exists for a machine that allows a user to create and manipulate patterns to be made in or on a workpiece. A need also exists for visualizing relative motion between the position of an operating head and a workpiece.

BRIEF SUMMARY OF THE INVENTION

The present disclosure provides a method of stitching a workpiece where a user moves a display to move an indicator relative to a displayed pattern, and a sewing head relative to the workpiece. The present disclosure also provides a method of stitching a workpiece where a user moves a display to move a displayed pattern relative to a fixed position of an indicator wherein the indicator corresponds to a location of a sewing head. Further, the present disclosure provides a method of stitching a workpiece where a user moves a display to move an indicator and a displayed pattern relative to the workpiece. The present method of stitching a workpiece implements the following steps: displaying a predetermined pattern on a display located adjacent to a control handle, the control handle operably connected to a sewing head moveable relative to the workpiece; displaying an indicator on the display, the indicator corresponding to a position of the sewing head relative to the workpiece; and moving the display and the control handle to move the indicator relative to a displayed pattern, and move the sewing head relative to the workpiece.

The present disclosure further provides for a method of stitching a workpiece. The method includes displaying a predetermined pattern on a display and manipulating the predetermined pattern on the display. An indicator is displayed on the display wherein the indicator corresponds to a position of a sewing head relative to the workpiece. Then, a control handle operably connected to the sewing head is moved, thereby moving the indicator relative to the pattern on the display and the sewing head relative to the workpiece.

The present disclosure also includes an apparatus for stitching a workpiece. The apparatus comprises a memory for retaining a plurality of patterns and a display connected to the memory for displaying a selected one of the patterns. The apparatus further comprises a sewing head moveable relative to the workpiece. A control handle is operably connected to the sewing head to move the sewing head relative to the workpiece, wherein the display is mounted relative to the control handle for movement with the control handle.

The present disclosure further includes a method of visualizing a position of an operating head relative to a workpiece. The method comprises displaying a pattern, such as a predetermined pattern, on a display, displaying an indicator on the display, the indicator corresponding to a position of the operating head relative to the workpiece, and manually moving a relative position of the pattern on the display corresponding to relative motion of at least one of the workpiece and the operating head.

Further, the present disclosure includes a method of visualizing a position of an operating head relative to a workpiece comprising tracking a relative physical position of the workpiece and the operating head in response to operator movement of at least one of the operating head and the workpiece; and displaying on a display an indicator relative to a workpiece image, the indicator corresponding to the tracked relative physical position.

In addition, the present disclosure relates to an apparatus for making a pattern in a workpiece, the apparatus comprising a free-motion machine having an operating head and a tracking device; a memory for retaining a plurality of patterns; a display connected to the memory for displaying a selected one of the patterns; and an indicator on the display corresponding to the position of the operating head relative to the workpiece, wherein the selected pattern is made in the workpiece by manually moving the workpiece relative to the operating head corresponding to the relative motion of the selected pattern on the display relative to the indicator on the display.

BRIEF DESCRIPTION OF THE SEVERAL VIEWS OF THE DRAWINGS

The foregoing features of this invention, as well as the invention itself, may be more fully understood from the following description of the drawings in which.

DETAILED DESCRIPTION OF THE INVENTION

At the outset, it should be appreciated that the use of the same reference number throughout the several figures designates a like or similar element.

For purposes of the present disclosure and appended claims, the conjunction "or" is to be construed inclusively (e.g., "a bear or a pig" would be interpreted as "a bear, or a pig, or both"; e.g., "a bear, a pig, or a mouse" would be interpreted as "a bear, or a pig, or a mouse, or any two, or all three"), unless: i) it is explicitly stated otherwise, e.g., by use of "either . . . or", "only one of . . . ", or similar language; or ii) two or more of the listed alternatives are mutually exclusive within the particular context, in which case "or" would encompass only those combinations involving non-mutually-exclusive alternatives.

For purposes of the present disclosure or appended claims, the words "comprise", comprising", "have", "having", "include", "including", and so on shall be construed as being open-ended, e.g., "including" shall be construed as "including but not limited to."

Figure 1:
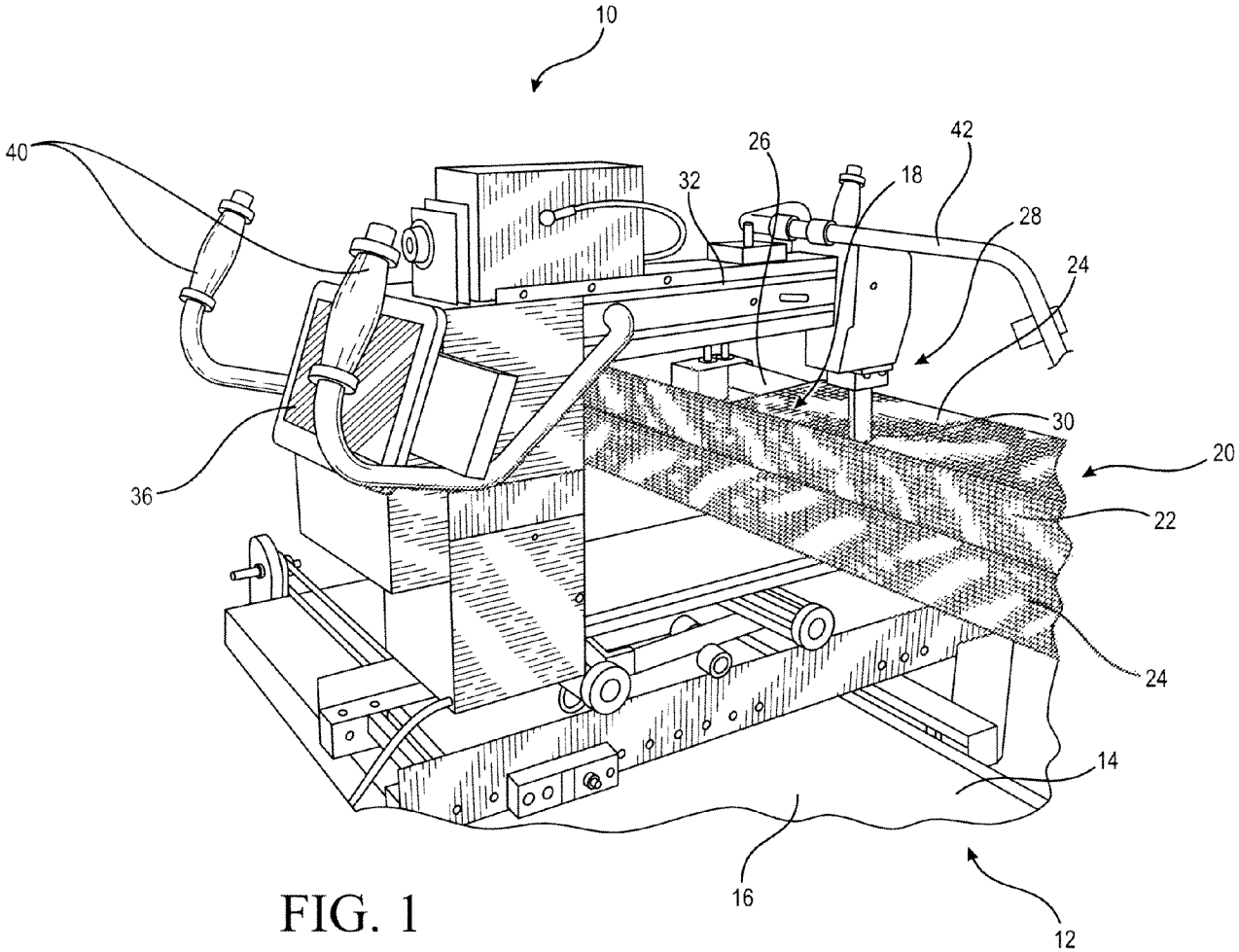
FIG. 1 is a perspective view of a configuration of a sewing machine showing a workpiece being stitched.
Figure 2:
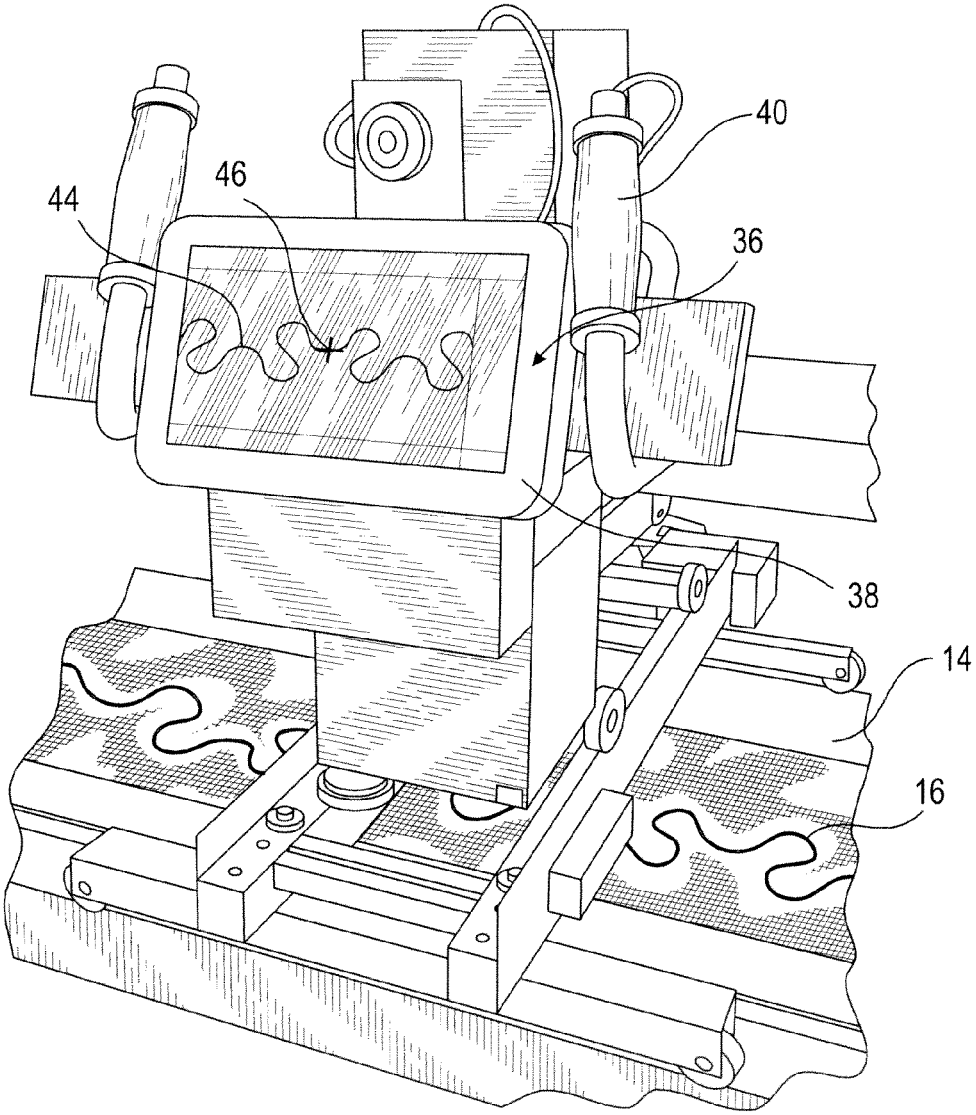
FIG. 2 is a front view of a sewing machine showing the display apparatus.

Referring to FIGS. 1-2, the present disclosure provides for a sewing machine 10 in accordance with a first configuration of the system. The sewing machine 10 generally includes a table 12 and an optional template platform 14. The workpiece assembly 18 includes a start roller 22 and a take-up roller 24, wherein the workpiece 20 is secured within the start roller 22, positioned tightly and fed into the take-up roller 24, thereby exposing a section 24 of the workpiece 20 to be sewn by a sewing head 28 having a sewing needle 30. The sewing machine 10 also includes a motor and power transmitting apparatus (not shown) for driving the sewing needle 30 axially in a repeating upward and downward motion. The sewing head 28 is mounted to an arm 32. The arm 32 couples the sewing head 28 and a display apparatus 36. The display apparatus includes a display screen or display 38, including, for example, an LCD touch screen. It is also contemplated the display apparatus can include a separable component such as a tablet computer, laptop computer, PDA, or phone (having a display).

In one configuration of the present disclosure, control handles 40 are adjacent the display apparatus 36. As shown in FIGS. 1 and 2, display apparatus 36 can be positioned between control handles 40. However, it should be appreciated by those having ordinary skill in the art that control handles 40 can be positioned above, below or at the side of the display apparatus 36. Further, it should be appreciated that the sewing machine 10 may have only one control handle for moving the display apparatus 36. The sewing machine 10 may have an additional control handle or set of control handles 42 positioned proximate the sewing head 28 allowing the user to sew a pattern onto the workpiece without the guidance of a pattern template 16. The control handles 40 are operably connected to the sewing head 28. Thus, the user controls the movement of the sewing head 28 relative to the workpiece by moving the control handles 40 during the sewing of the pattern onto the workpiece 20. In one configuration, the display apparatus 36 is mounted relative to the control handles 40 and moves with the control handles 40. That is, motion of the display apparatus 36 is the motion of the control handles 40. The sewing machine can include sensors or readers as well known in the art for monitoring the location of the sewing head. These sensors include, but are not limited to, optical sensors, counters, and mechanical position sensors, as well known in the art.

The display apparatus 36 displays on the screen 38, a pattern 44 wherein the pattern can be any one of a plurality of patterns stored in an electronic memory. The pattern 44 can be manipulated on the screen 38 by the user. For example, a user may resize or multiply the pattern to create a desired pattern that fits any quilt size. The manipulation can also include rotation, resizing, and reorientation of the pattern. In addition, an indicator 46 is displayed on the screen 38. The indicator 46 corresponds to a position of the sewing head 28 relative to the workpiece 20. More specifically, the display apparatus 36 includes a digital cross hair generator that accepts video input of the pattern 44 and then superimposes the indicator 46 on the output shown on the screen 38 to correspond with the position of the sewing head 28.

Once the pattern 44 is determined, the user moves the control handles 40 and display apparatus 36 to move the indicator 46 relative to the displayed pattern 44, and, therefore, the sewing head 28 relative to the workpiece 20. In another configuration, the user moves the control handles 40 and the display apparatus 36 to move the pattern 44 relative to a fixed position of the indicator 46 on the display screen, and, therefore, the sewing head 28 relative to the workpiece 20. In yet another configuration, the user moves the control handles 40 and the display apparatus 36 to move both the indicator 46 and the displayed pattern 44, and therefore, the sewing head 28 relative to the workpiece 20. As the user moves the control handles 40, during operation, the sewing head 28 sews the pattern traced by the indicator 46 on the screen 38 onto the exposed section 24 of the workpiece 20.

Figure 3:
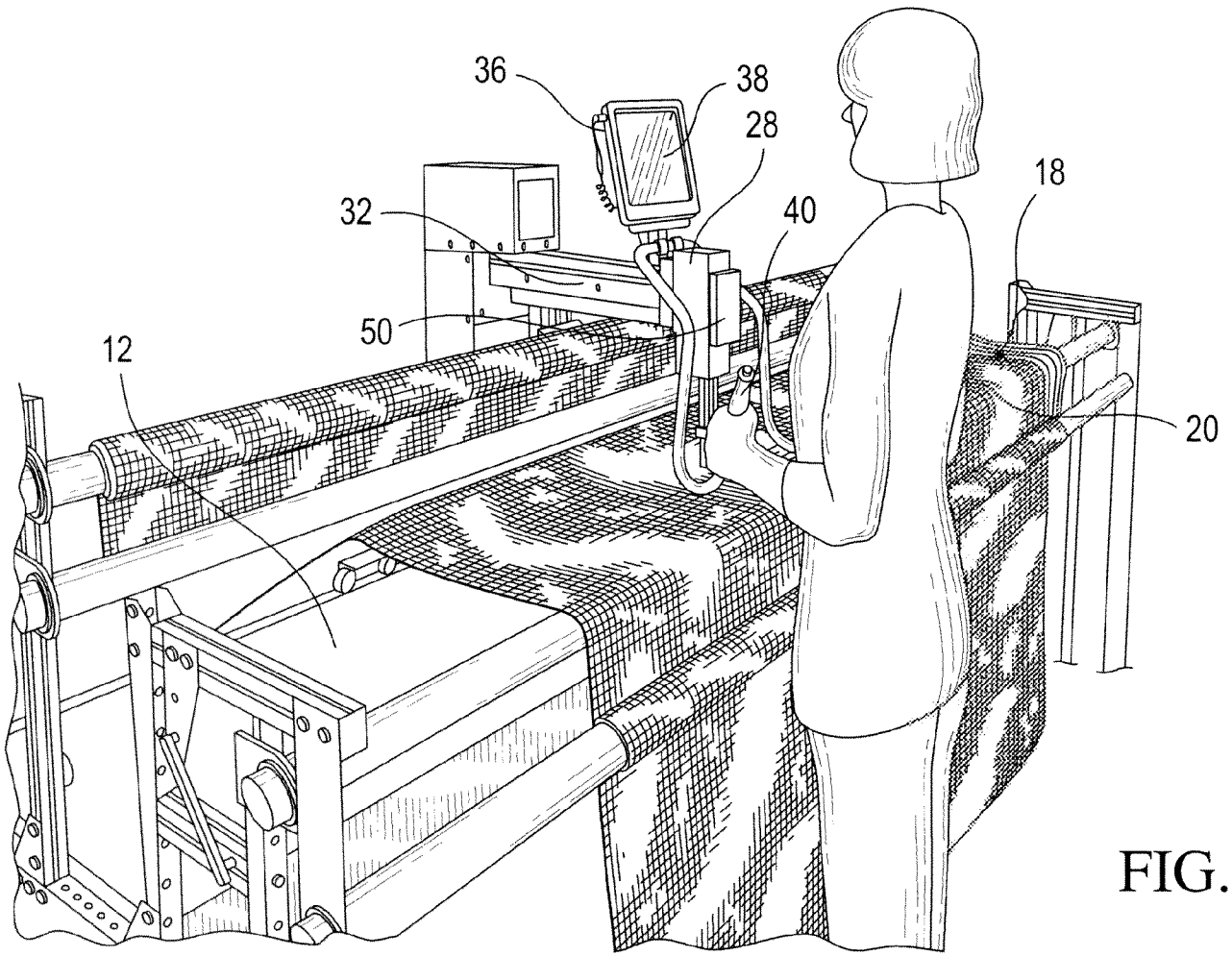
FIG. 3 is a perspective view of another configuration of a sewing machine showing workpiece being stitched.
Figure 4:
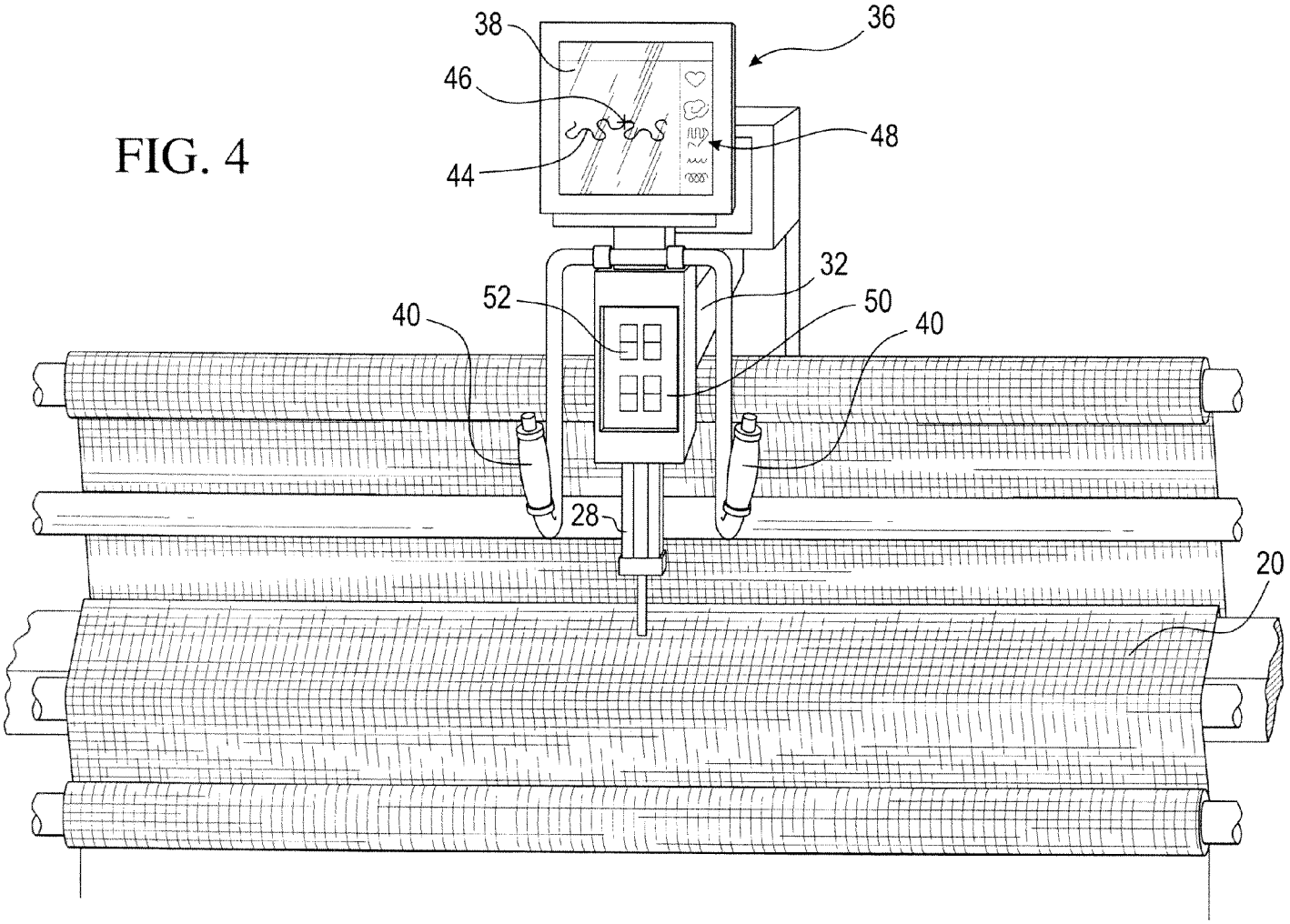
FIG. 4 is a front view of the display apparatus of the sewing machine shown in FIG. 3.

In the configuration of FIGS. 3-4, the workpiece assembly 18 includes a start roller 22 and a take-up roller 24, wherein the workpiece 20 is secured within the start roller 22 and fed into the take-up roller 24, thereby exposing a section 24 of the workpiece 20 to be sewn by a sewing head 28 having a sewing needle 30. The sewing head 28 is mounted to an arm 32, which couples the sewing head 28 to a display apparatus 36 having a screen 38.

A user can select and use a desired pattern 44 from an electronic pattern library. Alternatively, a user can acquire and use a desired pattern 44 from another source and store such pattern in the electronic pattern memory for later use. Further, the user can manipulate the pattern by resizing, reorientating, or multiplying the pattern to create a desired design that fits the workpiece size. The indicator 46 is displayed on the screen 38 of the display apparatus 36 which corresponds to a position of the sewing head 28 relative to the workpiece 20. Thus, in operation, a user moves the control handles 40 and display apparatus 36 to move the indicator 46 relative to the pattern 44 on the screen 38 and the sewing head 28 relative to the workpiece 20. As the user moves the control handles 40, during operation, the sewing head 28 sews the pattern displayed on the screen 38 onto the exposed section 24 of the workpiece 20. As stated supra, the indicator 46 or the pattern 44 may be in a fixed position on the display. Alternatively, both the indicator 46 and the displayed pattern 44 may move positions on the display when the user moves the control handles 40 to move the indicator 46 relative to the displayed pattern 44 and the sewing head 28 relative to the workpiece 20. It should be appreciated by those having ordinary skill in the art that if the display 36 is parallel to the workpiece 20, the movement of the control handles 40 along the x-axis and y-axis corresponds to the movement of the indicator 46 and/or pattern 44 on the screen 38. However, if the display 36 is perpendicular to the workpiece 20, the movement of the control handles 40 along the y-axis (moving the handles closer to or farther away from a user) will translate into movement of the indicator 46 and/or pattern 44 on the screen 38 along the z-axis (up and down). However, it is understood the screen 38 can be at any orientation to the workpiece 20.

In all configurations, as shown in FIGS. 1-4, the display apparatus 36 is controlled by a CPU, which can be a tablet computer having a touch screen 38. The screen 38 provides a user interface to allow the user to control the pattern sewn on the workpiece 20 of the sewing head 28. Referring to FIG. 4, for example, the sewing machine 10 may include a display apparatus 36 having a pattern selection section 48 having a plurality of patterns for selection. The pattern 44 selected by way of the pattern selection section 48 is displayed on the screen 38 in accordance with display image data stored in the ROM in advance. A user can also resize, multiply, reorient, or otherwise adjust a selected pattern. Alternatively, and as shown in FIGS. 3-4, the sewing machine 10 may comprise an additional touch screen 50 providing sewing head 28 operating switches including a start/stop switch 52 and controls to adjust the additional machine settings and functions as described supra.

Figure 5:
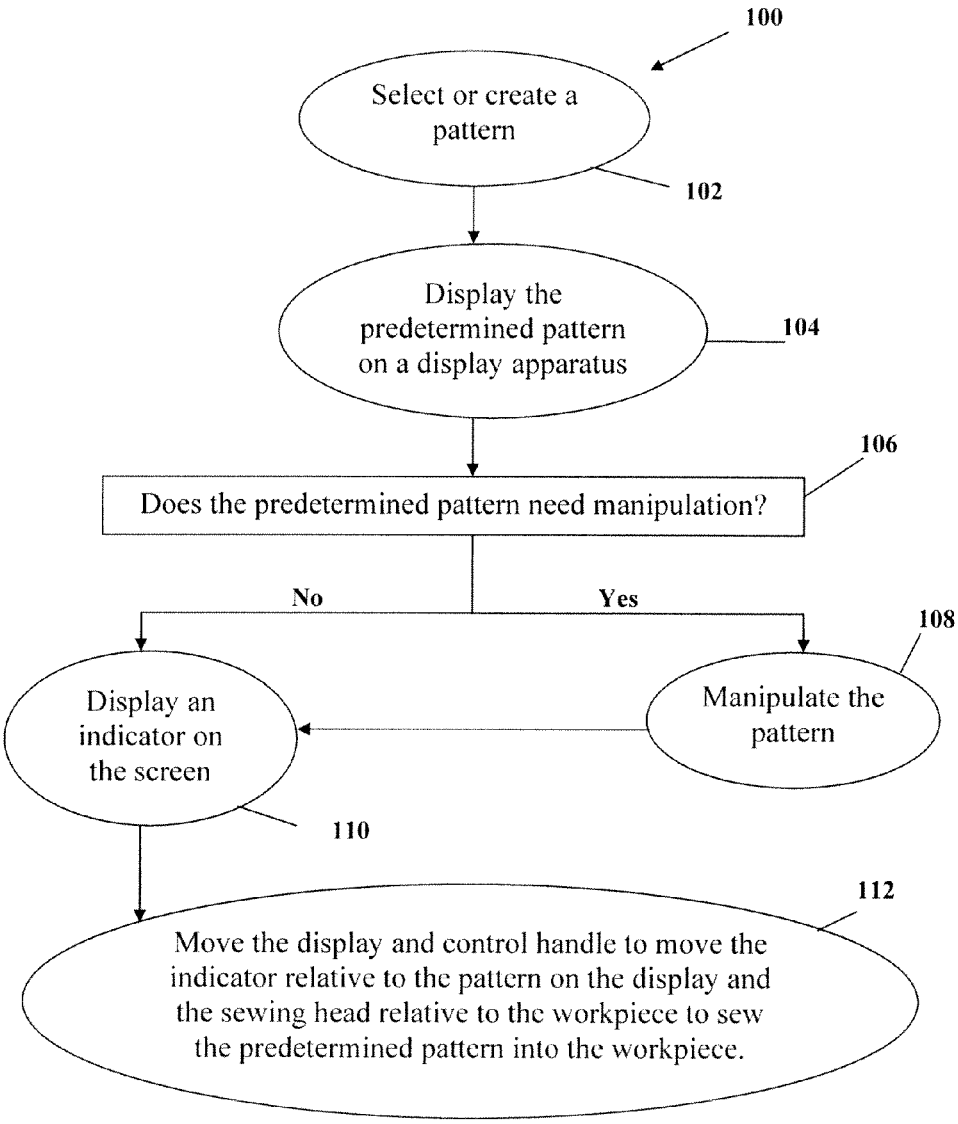
FIG. 5 is a flow chart illustrating a method of stitching a workpiece.

It should be appreciated that the method of stitching a workpiece may be implemented by means of a computer software program. FIG. 5 shows the main flow 100 of a computer program to be executed. First, according to step 102, a user selects or creates a pattern to be sewn onto a workpiece 20. According to step 104, this predetermined pattern 44 is displayed on a display apparatus 36 located adjacent to a control handle 40 which is operably connected to a sewing head 28 moveable relative to a workpiece 20. A user determines whether the predetermined pattern 44 needs manipulation, according to step 106. If the predetermined pattern requires manipulation as set forth in step 108, the user will use the touch screen 38 to manipulate the pattern 44 by, for example, resizing the pattern, multiplying all or portions of the pattern 44 to create a different or repeating pattern, or distorting the pattern to create a variation of the pattern. The user will then move to step 110 where the indicator 46 corresponding to a position of a sewing head 28 relative to the workpiece 20 is displayed on the screen 38.

According to step 112, a user will move the control handle 40 operatively connected to the sewing head 28 to simultaneously move the indicator 46 relative to the pattern 44 on the screen 38 and to move the sewing head 28 relative to the workpiece 20. Thus, the pattern 44 displayed on the screen 38 is sewn onto the workpiece 20. Once the pattern 44 is sewn across a first row of the workpiece 20, the workpiece 20 is moved to allow a second row of the pattern to be sewn onto the workpiece 20. This process is repeated until the user has sewn the desired pattern or patterns over the desired area of the workpiece 20. Such computer software program can be run on sewing machine having a quilting head that is equipped with stitch regulation.

The predetermined pattern can be selected from a pattern library stored in the computer program. In yet another configuration, a pattern template can be displayed on the screen 38.

It should be appreciated to those having ordinary skill in the art that the above described computer program can be used with other types of free-motion machines that are used to make, trace or impart patterns in workpieces by moving the workpiece relative to an operating head. Further, the workpiece can be any of a variety of materials or constructions, such as but not limited to fabrics, composites, laminates, wood, metal or plastic.

The operating head can be any of a variety of devices, including but not limited to sewing heads, routers, lasers, formers, welders, fastening heads and cutters. For example, the present system can be adapted for portable sewing machines, routers secured to a router table and drill presses, wherein the workpiece would be any type of fabric, composite, laminate, metal, plastic or wood material. In the configuration of the free-motion machine is a portable sewing machine, the operating head is a sewing head with a needle. Similarly, where the free-motion machine is a router table or drill press, the operating head is the router/drill press head and bit.

The free-motion machine includes a tracking device 208 for determining the position of a workpiece 20.

The tracking device 208 can include any of the known devices for tracking a position or movement of an object, such as a roller ball, a laser, mechanical link or arm, wheel or other device that can be used to track movement of the workpiece 20.

Typically, the tracking device 208 s adjacent the operating head to track the motion of the workpiece relative to the operating head. It is believed to be beneficial to locate the tracking device 208 proximal to the operating head for workpieces 20 that stretch, or are flexible or elastic. For workpieces 20 that are rigid or substantially inflexible, the tracking device 208 can be spaced from the operating head.

Figure 6:
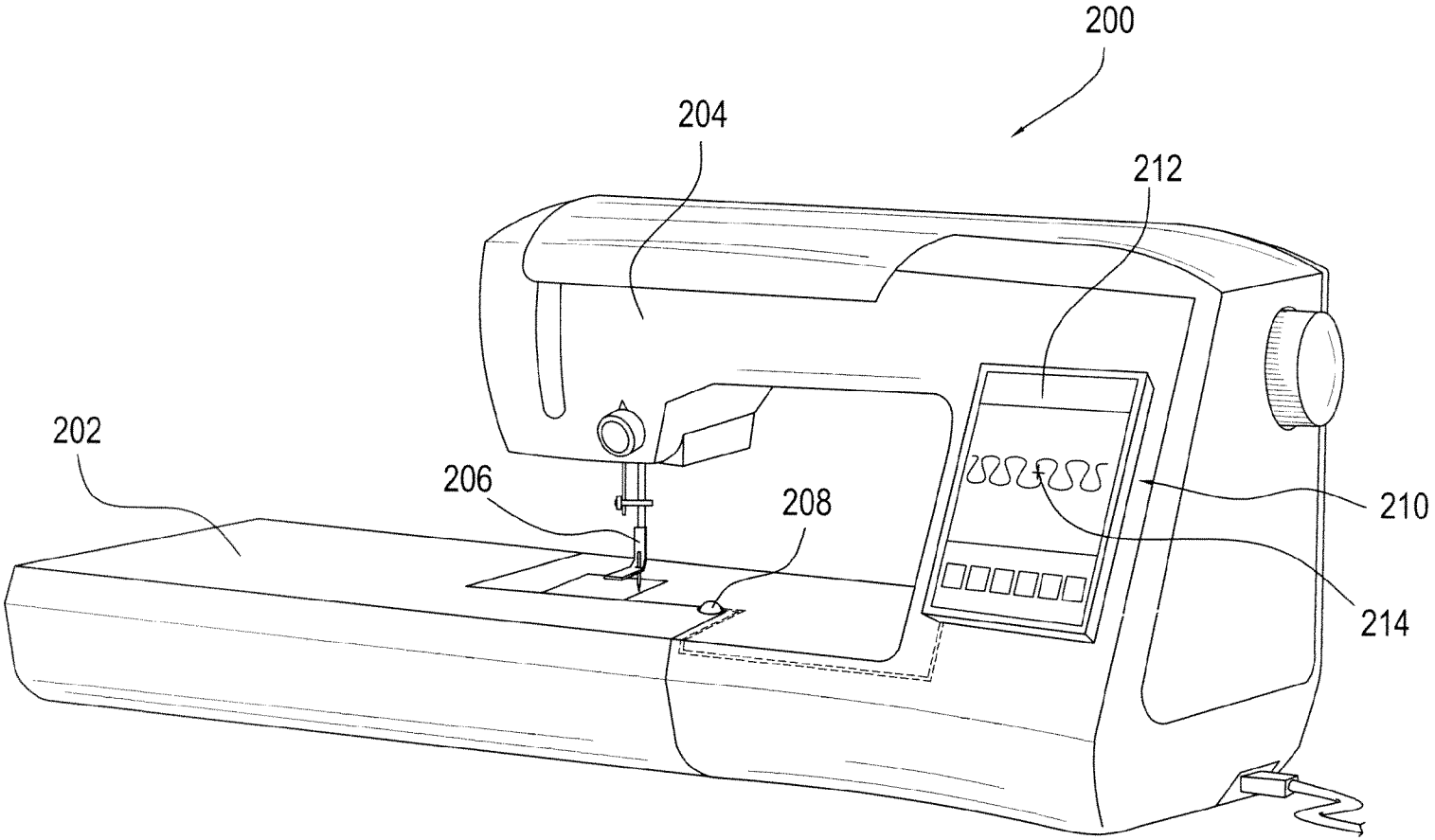
FIG. 6 is a front perspective view of a portable sewing machine showing a workpiece being stitched by a user.

Referring to FIG. 6, the present disclosure provides for a free-motion sewing machine 200. The sewing machine 200 generally includes a workpiece supporting base 202, a bracket arm 204 overhanging the workpiece supporting base 202, and an operating head 206. The sewing machine 200 further includes the tracking device 208 and a display 210, which includes the display screen 212. The screen 212 displays an image of the workpiece, the indicator 46 corresponding to a position of the operating head relative to the workpiece 20, and a pattern overlaying the workpiece, and provides a user interface to allow the user to control the type of pattern sewn on the workpiece by the operating head 206. The tracking device 208 is positioned on the sewing machine 200 to track the position and/or movement of the workpiece 20. To sew a desired pattern into the workpiece 20, the user selects a desired pattern and moves the workpiece 20 relative to the operating head 206 while the operating head 206 is sewing. The display 210 shows an indicator 214, which corresponds to the position of the operating head 206 and the position and movement of the workpiece 20 relative to the operating head. The position of the pattern displayed on the screen 212 moves according to the position of the workpiece 20. Thus, the user is able to sew the displayed pattern onto the workpiece 20 by moving the workpiece. Once the pattern is sewn across a portion of the workpiece 20, the workpiece is moved to allow a new portion of the pattern to be sewn onto the workpiece. This process is repeated until the user has sewn the desired pattern or patterns over the desired area of the workpiece 20.

Therefore, the present system provides a method of visualizing the operating head 206 relative to the workpiece 20, by tracking a relative position of the operating head and at least a portion of the workpiece in response to operator movement of at least one of the operating head and the workpiece; and displaying on the display 212 (i) the indicator 214 corresponding to the operating head and (ii) movement of at least one of the indicator and the pattern on the display, the movement on the display corresponding to operator movement of at least one of the workpiece and the operating head.

The present system has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A method of stitching a workpiece, the method comprising:
   (a) displaying a predetermined pattern on a display located adjacent to a control handle, the control handle operably connected to a sewing head moveable relative to the workpiece, wherein the displayed predetermined pattern is not stitching on the workpiece;
   (b) displaying an indicator on the display, the indicator corresponding to a position of the sewing head relative to the workpiece; and
   (c) moving the display and the control handle to move the indicator relative to the displayed predetermined pattern and the sewing head relative to the workpiece.

2. The method of claim 1, further comprising simultaneously moving the display and the control handle.

3. The method of claim 1, further comprising acquiring a predetermined pattern from an electronic memory.

4. The method of claim 1, further comprising manipulating the predetermined pattern on the display.

5. The method of claim 1, further comprising acquiring the predetermined pattern from a user.

6. The method of claim 1, wherein the method of moving the display and the control handle to move the indicator relative to the display pattern and the sewing head relative to the workpiece further comprises moving the indicator relative to the pattern in a fixed position on the display.

7. The method of claim 1, wherein the method of moving the display and the control handle to move the indicator relative to the display pattern and the sewing head relative to the workpiece further comprises moving both the indicator and the pattern on the display.

8. The method of claim 1, wherein the method of moving the display and the control handle to move the indicator relative to the display pattern and the sewing head relative to the workpiece further comprises moving the pattern relative to the indicator in a fixed position on the display.

9. A method of stitching a workpiece, the method comprising:
   (a) displaying an unsewn predetermined pattern on a display;
   (b) manipulating the predetermined pattern on the display;
   (c) displaying an indicator on the display, the indicator corresponding to a position of a sewing head relative to the workpiece; and
   (d) moving a control handle operably connected to the sewing head to move the indicator relative to the unsewn predetermined pattern on the display and move the sewing head relative to the workpiece.

10. The method of claim 9, further comprising locating the display adjacent to the control handle.

11. The method of claim 9, further comprising simultaneously moving the display and control handle.

12. The method of claim 9, further comprising acquiring a predetermined pattern from an electronic memory.

13. The method of claim 9, further comprising acquiring the predetermined pattern from a user.

14. The method of claim 9, wherein the step of moving the control handle operably connected to the sewing head to move the indicator relative to the display pattern on the display and to move the sewing head relative to the workpiece further comprises moving the indicator relative to the display pattern in a fixed position on the display.

15. The method of claim 9, wherein the step of moving the control handle operably connected to the sewing head to move the indicator relative to the display pattern on the display and to move the sewing head relative to the workpiece further comprises moving both the indicator and the display pattern on the display.

16. The method of claim 9, wherein the step of moving the control handle operably connected to the sewing head to move the indicator relative to the display pattern on the display and to move the sewing head relative to the workpiece further comprises moving the display pattern relative to the indicator in a fixed position on the display.

17. An apparatus for stitching a workpiece, the apparatus comprising:
   (a) a memory for retaining a plurality of predetermined patterns;
   (b) a sewing head moveable relative to the workpiece;
   (c) a display connected to the memory for displaying an indicator corresponding to a position of the sewing head relative to the workpiece and a selected one of the predetermined patterns, wherein the displayed predetermined pattern is independent of stitching in the workpiece;
   (d) a control handle operably connected to the sewing head to move the sewing head and the display relative to the workpiece to move the indicator relative to the selected one of the predetermined patterns, wherein the display is mounted relative to the control handle for movement with the control handle.

18. The apparatus of claim 17 wherein the indicator is centrally- positioned on the display.

19. The apparatus of claim 17 wherein the indicator is in a fixed position on the display.

20. The apparatus of claim 17 wherein the display is removably secured to the sewing head.

21. A method of visualizing an operating head relative to a workpiece, the method comprising:

(a) displaying an unsewn predetermined pattern to be formed in the workpiece on a display;

(b) displaying an indicator on the display, the indicator corresponding to a position of the operating head relative to the workpiece;

(c) manually moving the operating head to change a position of the operating head relative to the workpiece; and (d) moving the displayed predetermined pattern relative to the displayed indicator, wherein movement of the displayed predetermined pattern relative to the displayed indicator corresponds to the manual movement of the operating head.

22. The method of claim 21 further comprising displaying an image of the workpiece on the display and manually moving a relative position of the pattern and the workpiece image on the display corresponding to the relative motion of at least one of the workpiece and the operating head.

23. The method of claim 21, further comprising moving the predetermined pattern relative to a fixed position of the displayed indicator on the display.

24. The method of claim 21, further comprising moving both the indicator and the predetermined pattern on the display.

25. The method of claim 21, further comprising moving the indicator relative to a fixed position of the predetermined pattern on the display.

26. A method of visualizing an operating head relative to a workpiece, the method comprising:

(a) tracking a relative position of the operating head and at least a portion of the workpiece in response to operator movement of the operating head and the at least a portion of the workpiece; and (b) displaying on a display (i) an indicator corresponding to a position of the operating head relative to the workpiece and a predetermined pattern, and (ii) movement of the indicator relative to the predetermined pattern on the display, the movement on the indicator corresponding to operator movement of the operating head, wherein the displayed predetermined pattern includes an unsewn portion.

27. The method of claim 26, further comprising moving the operating head relative to a fixed position of the workpiece.

28. The method of claim 26, further comprising moving the workpiece relative to a fixed position of the operating head.

29. An apparatus for making a pattern in a workpiece, the apparatus comprising:

(a) a free-motion machine having an operating head and a tracking device;

(b) a memory for retaining a plurality of unsewn predetermined patterns;

(c) a display displaying a selected one of the unsewn predetermined patterns from the memory, wherein the displayed predetermined pattern is independent of an image of the workpiece; and (d) an indicator on the display corresponding to a position of the workpiece relative to the operating head, wherein the selected unsewn predetermined pattern is made in the workpiece by manually moving the workpiece relative to the operating head and the selected predetermined pattern moves relative to the displayed indicator corresponding to movement of the workpiece relative to the operating head.

30. The apparatus of claim 29, wherein the indicator is centrally positioned on the display.

31. The apparatus of claim 29, wherein the indicator is in a fixed position on the display.

* * * * *